US006326113B1

(12) United States Patent
Okuda et al.

(10) Patent No.: US 6,326,113 B1
(45) Date of Patent: Dec. 4, 2001

(54) CHARGE CONTROL AGENT MANUFACTURING PROCESS THEREOF AND TONER FOR DEVELOPING ELECTROSTATIC IMAGES

(75) Inventors: Toshiyuki Okuda; Yoshitaka Taguchi, both of Nagoya; Akihiro Tada; Shun-ichiro Yamanaka, both of Osaka, all of (JP)

(73) Assignees: Chukyo Yushi Co., Ltd.; Orient Chemical Industries, Ltd., both of (JP)

( * ) Notice: Subject to any disclaimer, the term of this patent is extended or adjusted under 35 U.S.C. 154(b) by 0 days.

(21) Appl. No.: 09/594,634

(22) Filed: Jun. 15, 2000

(30) Foreign Application Priority Data

Jun. 18, 1999 (JP) ..... 11-173273

(51) Int. Cl.[7] ..... G03G 9/097
(52) U.S. Cl. ..... 430/108.21; 430/137.2
(58) Field of Search ..... 430/106, 110, 430/137, 108.21, 137.2

(56) References Cited

U.S. PATENT DOCUMENTS 4,401,741 8/1983 Miyakawa et al. ..... 430/110
4,937,167 * 6/1990 Moffat et al. ..... 430/137
5,612,777 * 3/1997 Malhotra ..... 399/226

FOREIGN PATENT DOCUMENTS 0 463 822 A2 1/1992 (EP) .
0 523 733 A1 1/1993 (EP) .
0 542 051 A1 5/1993 (EP) .

OTHER PUBLICATIONS

XP 002150846, Oct. 23, 1992, WPI Publication.
XP 002150847, Nov. 26, 1993, WPI Publication.
XP 002150960, Aug. 31, 1994, WPI Publication.
Patent Abstracts of Japan, Jan. 25, 1996.

* cited by examiner

*Primary Examiner*—John Goodrow
(74) *Attorney, Agent, or Firm*—McGlew and Tuttle, P.C.

(57) ABSTRACT

Charge control agent comprising a base particle containing at least a charge control substance, and a granulating agent, said base particle being granulated using said granulating agent, and said granulating agent being at least one selected from the group consisting of anionic surfactants, nonionic surfactants, cationic surfactants, natural water-soluble high molecular compounds and synthetic water-soluble high molecular compounds; manufacturing process thereof; and toner for developing electrostatic images containing the charge control agent for the purpose of charge control, and also containing a coloring agent and a resin.

36 Claims, 2 Drawing Sheets

CHARGE CONTROL AGENT MANUFACTURING PROCESS THEREOF AND TONER FOR DEVELOPING ELECTROSTATIC IMAGES

BACKGROUND OF THE INVENTION

1. Field of the Invention

The present invention relates to a charge control agent for electrophotography etc., and a toner for developing electrostatic latent images using said charge control agent.

2. Description of the Prior Art

In copying machines and other instruments based on electrophotography, various toners containing a coloring agent, a fixing resin and other substances are used to visualize the electrostatic latent image formed on the photoreceptor having a photosensitive layer containing a photoconductive substance. Such toners are required to show satisfactory performance in terms of chargeability, fixability, offset resistance, durability, etc.

In recent years, to achieve image quality improvement, while copying and printing speeds are increased, there have been increased demands for improved charge characteristics of toners, such as increased charge rise speeds, and for toner fixability on recording papers, such as excellent low-temperature fixability and offset resistance. Such demands for improved toner performance are intensifying with the advance in performance sophistication of copying machines and printers.

Chargeability is a key factor in electrostatic latent image-developing systems. Thus, to appropriately control the chargeability of a toner, a charge control agent providing a positive or negative charge is often added to the toner. Of the conventional charge control agents in actual application, those providing a positive charge for a toner include nigrosine dyes and quaternary ammonium salt compounds. Guanidine, imidazole derivatives, etc. have also been proposed as such toners. Those providing a negative charge for a toner include salicylic acid derivative metal compounds and azo dye-metal complexes.

Many of the conventional charge control agents which are salicylic acid derivative metal compounds, azo dye-metal complexes or quaternary ammonium salts provide excellent chargeability when added to a toner. However, some problems remain to be resolved, including poor fluidity of the charge control agent itself, unsatisfactory levels of dispersibility in fixing resins and durability in multiple repeated use of toners, and relatively low clearness of initial copying images due to insufficient charge rise speeds.

The present invention was developed in view of the above problems in the prior art, and is directed to provide a charge control agent which is excellent in charge control substance uniform dispersibility in resins for toners, sharp and highly uniform in charge amount distribution, quick in charge rise, and excellent in charge stability over time, non-dependency on environment, storage stability and durability, and which does not adversely affect toner fixability and offset resistance when used in toners of various compositions; a manufacturing process thereof; and a toner for developing electrostatic images containing said charge control agent.

SUMMARY OF THE INVENTION

The charge control agent of the present invention for accomplishing the above objects comprises a base particle containing at least a charge control substance, and a granulating agent, said base particle being granulated using said granulating agent (granulation aid), and said granulating agent being at least one selected from the group consisting of anionic surfactants, nonionic surfactants, cationic surfactants, natural water-soluble high molecular compounds and synthetic water-soluble high molecular compounds.

The charge control agent of the present invention has a constant particle diameter and a sharp particle size distribution. In particular, the charge control agent of the present invention has a remarkably improved charge control substance uniform dispersibility in resins for toners, is sharp and highly uniform in charge amount distribution, quick in charge rise, and excellent in charge stability over time, non-dependency on environment, storage stability and durability. In addition, the charge control agent of the present invention is excellent in storage stability and durability, and does not adversely affect toner fixability and offset resistance when used in toners of various compositions.

With these features, the charge control agent of the present invention resolves the problems in conventional charge control agents, which have great variation of particle diameter and wide particle size distribution, which, when used in toners, are difficult to uniformly disperse in resins for toners and cause variation in toner surface charge distribution, and which are unsatisfactory in terms of charge retention in repeated use of the toner.

In addition, the toner of the present invention for developing electrostatic images contains the aforementioned charge control agent for the purpose of charge control, and also contains a coloring agent and a resin.

The toner of the present invention for developing electrostatic images has a remarkably improved charge control substance uniform dispersibility in resins for toners, is sharp and highly uniform in charge amount distribution, quick in charge rise, and excellent in charge stability over time, non-dependency on environment, storage stability and durability. In a toner obtained by polymerizing a monomer to constitute a resin for a toner along with a given set of ingredients such as a charge control agent, the charge control substance is uniformly dispersed to provide an excellent charge characteristic. In addition, the charge control agent of the present invention is excellent in storage stability and durability, and does not adversely affect toner fixability and offset resistance.

In addition, the process of the present invention for manufacturing a charge control agent comprises a fine milling step for finely milling a subject containing at least a charge control substance, and a granulation step for granulating a finely milled base particle using a granulating agent, said granulating agent being at least one selected from the group consisting of anionic surfactants, nonionic surfactants, cationic surfactants, natural water-soluble high molecular compounds and synthetic water-soluble high molecular compounds.

By this method, a charge control agent comprising granulated finely milled base particles is obtained.

DETAILED DESCRIPTION OF THE INVENTION

Figure 1:
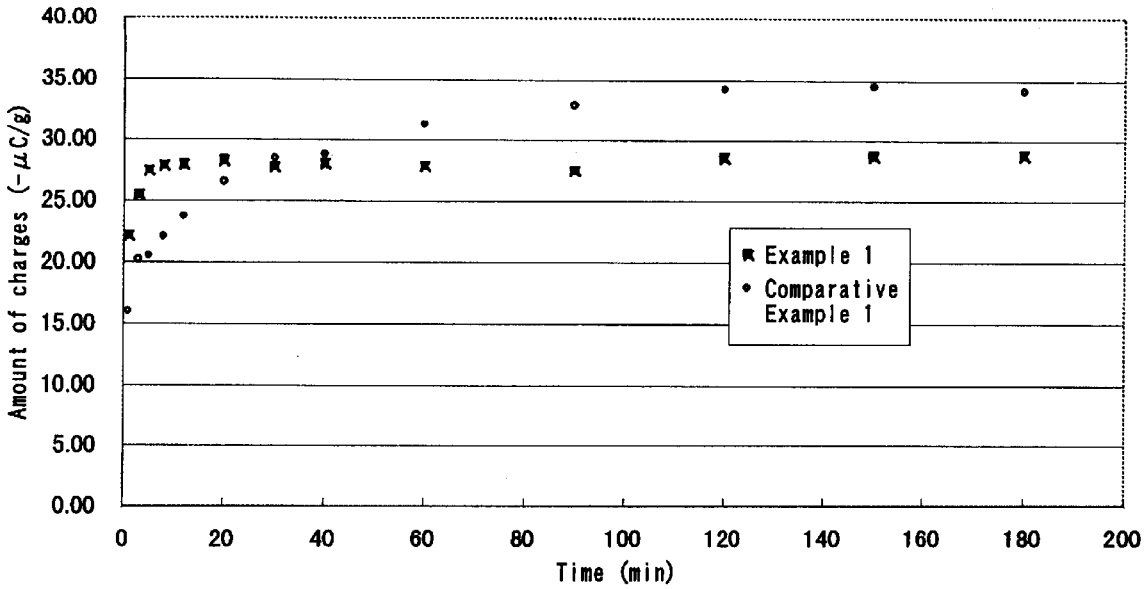
FIG. 1 is a diagram showing temporal changes in the amounts of charges for the toners obtained in Example 1 and Comparative Example 1.

The aforementioned charge control substance refers to a substance which serves for charge control, charge enhancement or the like for toners of developing electrostatic images or for electrostatic powder paints, and may be at least one selected from the group consisting of (a) metal compounds having an aromatic hydroxycarboxylic acid as a ligand, (b) metal compounds having an aromatic dicarboxylic acid as a ligand, (c) metal compounds having a monoazo compound as a ligand, (d) calix(n)arene compounds, and (e) quaternary ammonium salt compounds.

The aforementioned base particle containing at least a charge control substance may consist of the charge control substance alone, and may be such that the charge control substance accounts for not less than 70% by weight, not less than 80% by weight, or not less than 90% by weight.

In addition, it is desirable that the aforementioned base particle be finely milled, or have a mean particle diameter of 0.1 to 8 μm. More desirably, the mean particle diameter is 0.1 to 3 μm. In this case, by kneading the charge control agent along with a resin for a toner in a molten state, mixing it with a monomer to constitute a resin for a toner, etc., for example, particles containing at least a charge control substance can be highly uniformly dispersed in the resin for the toner in the form of fine particles such as base particles.

The term particle diameter (diameter of particle) as used herein refers to a light scattering diameter, and is determined using, for example, a laser diffraction/scattering particle size analyzer (LA-920 produced by Horiba, Ltd., etc.). Mean particle diameter means the particle diameter corresponding to cumulative 50% of the volume reference (median diameter).

The aforementioned base particle containing at least a charge control substance (preferably one of Compounds (a) to (e) above) can be effectively and relatively easily granulated using at least one granulating agent selected from the group consisting of (f) anionic surfactants, (g) nonionic surfactants, (h) cationic surfactants, (i) natural water-soluble high molecular compounds and (j) synthetic water-soluble high molecular compounds. Of course, a large number of base particles are contained in the charge control agent of the present invention. In a charge control agent which provides a negative charge, there can be used as a granulating agent one or more selected from the group consisting of anionic surfactants, nonionic surfactants, natural water-soluble high molecular compounds and synthetic water-soluble high molecular compounds, for example. In a charge control agent which provides a positive charge, there can be used as a granulating agent one or more selected from the group consisting of nonionic surfactants, cationic surfactants, natural water-soluble high molecular compounds and synthetic water-soluble high molecular compounds, for example.

The amount of granulating agent used in the charge control agent of the present invention may, for example, be 1 to 20% by weight relative to the charge control substance, and is preferably 5 to 15% by weight. It is desirable that the charge control agent of the present invention be such that the entire content or major content other than the granulating agent (e.g., not less than 70% by weight, not less than 80% by weight, or not less than 90% by weight of the content other than the granulating agent) is the base particle.

To stably obtain a uniform charge control agent by granulation, it is preferable that the granulating agent comprise two or more selected from the group consisting of anionic surfactants, nonionic surfactants, cationic surfactants, natural water-soluble high molecular compounds and synthetic water-soluble high molecular compounds. Examples of such granulating agents include combinations of an anionic surfactant, nonionic surfactant or cationic surfactant and a natural water-soluble high molecular compound and/or synthetic water-soluble high molecular compound. More specifically, it is preferable that a nonionic surfactant and a natural water-soluble high molecular compound, an anionic surfactant and a natural water-soluble high molecular compound, a synthetic water-soluble high molecular compound and an anionic surfactant, etc., for example, be used in combination.

The mean particle diameter of the charge control agent of the present invention (granulated charge control agent particles) may be 5 to 100 μm, preferably 5 to 50 μm, more preferably 5 to 45 μm, and still more preferably 10 to 40 μm. Granulation sharpens the particle size distribution. This aspect is important to the stabilization of charge controllability.

The charge control agent of the present invention (granulated charge control agent particles) is preferably such that not less than 90% of the particles have a particle diameter of 5 to 100 μm. More preferably, not less than 90% of the particles have a particle diameter of 5 to 88 μm.

The shape of charge control agent particles affects their dispersibility in resins for toners. It is desirable that the charge control agent of the present invention be such that not less than 90% (or not less than 95%) of the charge control agent particles granulated have a minor-to-major axis diameter ratio of 0.8 to 1.0 (more preferably 0.9 to 1.0). As the shape of charge control agent particles is thus made uniform, the charge control substance uniform dispersibility in resins for toners increases.

The bulk density of the charge control agent of the present invention (granulated charge control agent particles) is preferably 2.0 to 7.0 ml/g, more preferably 3.0 to 5.0 ml/g.

The charge control agent of the present invention is obtained by granulating base particles containing at least a charge control substance using the aforementioned granulating agent. Useful methods of granulation include, but are not limited to, commonly known methods of granulation, e.g., spray drying granulation, fluidized bed granulation and tumbling fluidized bed drying granulation.

When the aforementioned base particle is used as finely milled or as of a mean particle diameter of 0.1 to 8 μm (or 0.1 to 3 μm), the process for manufacturing a charge control agent may comprise a fine milling step for finely milling a subject containing at least a charge control substance, and a granulation step for granulating the finely milled base particle using the aforementioned granulating agent.

When the method of granulation used is spray drying granulation, for example, a mechanical mill such as a colloid mill, sand mill or ball mill may be used as necessary in previously uniformly mixing a subject containing at least a charge control substance, a granulating agent and a solvent, using the Disper Mixer, the Homo-mixer, or the like. By treating the resulting dispersion using a spray drier, a granulated charge control agent is obtained.

Although the aforementioned granulation step alone or both the fine milling step and granulation step can, for example, be performed in an organic solvent or an aqueous system, it is preferable in view of manufacturing process cost and environmental safety that granulation be performed in an aqueous system.

Furthermore, in the granulation for preparing the charge control agent of the present invention, the previous use of a solvent to prepare dispersion liquid is not always necessary. As long as the method of granulation used is fluidized bed granulation, high-speed air stream collision granulation, or the auk like, wherein base particles containing at least a charge control substance and the aforementioned granulating agent are uniformly mixed and treated, these may be in a solid-solid or solid-liquid form.

Granulating agents (f) to (j) above in the present invention are not subject to limitation; respective commonly known substances can be used. Examples thereof include, but are not limited to, the following substances.

Examples of (f) anionic surfactants above include fatty acids and salts thereof, dialkyl sulfosuccinates, β-olefinsulfonates, alkyl benzenesulfonates, alkyl naphthalenesulfonates, alkyl sulfates, polyoxyethylene alkyl ether sulfates, alkyl phosphates, polyoxyethylene alkyl ether phosphates and naphthalenesulfonate formalin condensates.

Preference is given to naphthalenesulfonate formalin condensates, alkyl naphthalenesulfonates and alkyl benzenesulfonates.

Examples of (g) nonionic surfactants above include polyoxyethylene alkyl ethers, polyoxyethylene alkyl phenyl ethers, polyoxyethylene polyoxypropylene glycol, polyoxyethylene sorbitan fatty acid partial esters and fatty acid diethanolamides.

Preference is given to polyoxyethylene alkyl ethers, polyoxyethylene alkyl phenyl ethers and polyoxyethylene polyoxypropylene glycol.

Examples of (h) cationic surfactants above include aliphatic amines, quaternary ammonium salts and alkylpyridinium salts.

Examples of (i) natural water-soluble high molecular compounds above include methyl cellulose, hydroxyethyl cellulose, hydroxypropylmethyl cellulose, carboxymethyl cellulose, chemically modified starch, gum arabic, algin, cyclodextrin, pullulan, casein, gelatin and lignin.

Preference is given to gelatin, casein, algin, methyl cellulose, carboxymethyl cellulose, lignin sulfonate and gum arabic.

Examples of (j) synthetic water-soluble high molecular compounds above include polyvinyl alcohol, polyethylene oxide, polyacrylates, styrene-maleic anhydride copolymers, olefin-maleic anhydride copolymers, polyvinylpyrrolidone, polyethylene glycol, polyester, polyamide and polyurethane.

Preference is given to polyacrylates, styrene-maleic anhydride copolymers, olefin-maleic anhydride copolymers and polyester.

Granulating agents (f) to (j) above in the present invention may be used in the form of an acid or a salt thereof. Useful salts include, for example, metal salts based on alkali metals (Na, K, etc.), ammonium salts, amine salts based on organic amines (aliphatic primary amines, aliphatic secondary amines, aliphatic tertiary amines, etc.), and organic ammonium salts.

In addition, granulating agents (f) to (j) above in the present invention may be used after being modified by esterification, etherification, etc., as long as the accomplishment of the expected object of the present invention to assure its effect is not interfered with. The terminal substituent resulting from such modification is exemplified by normal or branched alkyl groups (e.g., methyl group, ethyl group, n-propyl group, n-butyl group, t-butyl group, n-pentyl group, hexyl group, heptyl group, octyl group, nonyl group, dodecyl group), normal or branched alkenyl groups (e.g., vinyl group, allyl group, propenyl group, butenyl group), hydroxyl-substituted alkyl groups (e.g., 2-hydroxyethyl group, hydroxymethyl group), halogen-substituted alkyl groups (e.g., chloromethyl group, 2-chloroethyl group), alkokxyl-substituted alkyl groups (e.g., methoxymethyl group, ethoxybutyl group, butoxyethyl group, butoxypropyl group, propoxyethoxyethyl group), cycloalkyl groups (e.g., cyclopropyl group, cyclopentyl group, cyclohexyl group), phenyl groups having or not having a substituent, and benzyl groups having or not having a substituent.

Granulating agents (i) to (j) above in the present invention may be used not only as clearly dissolved in water, but also as turbidly dissolved with a non-dissolved portion or as dispersed in emulsion.

Compounds (a) to (e) above for use as a charge control substance in the present invention are exemplified as follows:

(a) Metal Compounds Having an Aromatic Hydroxycarboxylic Acid as a Ligand

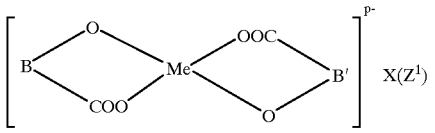

[In the formula above, each of B and B' is a benzene ring or naphthalene ring having or not having a substituent (B and B' may be identical or not);
M is a divalent metal or a metal of higher valence;
p is an integer of 0 to 4;
$Z^1$ is an organic cation or an inorganic cation;
X is an integer of 0 to 2.]

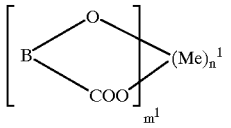

[In the formula above, B is a benzene ring or naphthalene ring having or not having a substituent;
$m^1$ is an integer of 3 or more;
$n^1$ is an integer of 1 or more;
Me is a divalent metal or a metal of higher valence.]

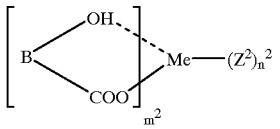

[In the formula above, B is a benzene ring or naphthalene ring having or not having a substituent;
Me is a divalent metal or a metal of higher valence;
$Z^2$ is an organic anion or an inorganic anion;
each of $m^2$ and $n^2$ is a positive integer;
$m^2+n^2$ represents the oxidation number of the metal M.]

The metal compounds having an aromatic hydroxycarboxylic acid as a ligand of Formulas (I) to (III) below are preferred from the viewpoint of charge retention, dispersibility in resins for toners, and toner fixability. For this reason, the metal compound having an aromatic hydroxycarboxylic acid as a ligand, as the charge control substance constituting the base particle in the present invention, preferably comprises one or more compounds of Formulas (I) to (III) below.

(I)

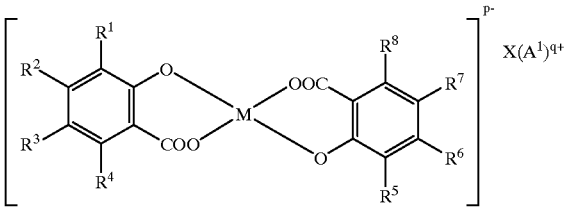

[In Formula (I),
each of $R^1$ to $R^8$ is H (hydrogen), a hydroxyl group, a normal or branched alkyl group having 1 to 12 carbon atoms, an alkenyl group, an aryl group, an aralkyl group, a halogen or a nitro group ($R^1$ to $R^8$ may be identical or not);

M is a divalent, trivalent or tetravalent metal;

p is 0, 1 or 2;

q is 1 or 2;

$(A^1)^{q+}$ is $H^+$, $NH_4^+$, a cation based on an alkali metal (Na, K, etc.), a cation based on an organic amine (aliphatic primary amine, aliphatic secondary amine, aliphatic tertiary amine, etc.), or a quaternary organic ammonium ion;

X is 0, 1 or 2.]

(II)

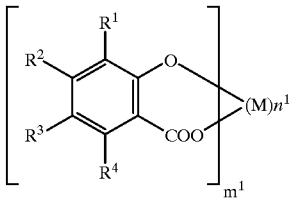

[In Formula (II), each of $R^1$ to $R^4$ is H (hydrogen), a hydroxyl group, a normal or branched alkyl group having 1 to 12 carbon atoms, an alkenyl group, an aryl group, an aralkyl group, a halogen or a nitro group ($R^1$ to $R^4$ may be identical or not);

$m^1$ is an integer of 3 or more;

$n^1$ is an integer of 1 or more;

M is a divalent or trivalent metal.]

(III)

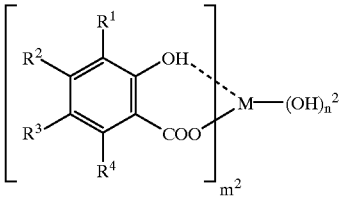

[In Formula (III), each of $R^1$ to $R^4$ is H (hydrogen), a hydroxyl group, a normal or branched alkyl group having 1 to 12 carbon atoms, an alkenyl group, an aryl group, an aralkyl group, a halogen or a nitro group ($R^1$ to $R^4$ may be identical or not);

M is a divalent or trivalent metal;

each of $m^2$ and $n^2$ is a positive integer;

$m^2+n^2$ represents the oxidation number of the metal M.]

Examples of $R^1$ to $R^8$ in Formulas (I) to (III) above include

H (hydrogen);

hydroxyl group;

normal or branched alkyl groups having about 1 to 12 carbon atoms, such as methyl group, ethyl group, propyl group, i(iso)-propyl group, butyl group, i-butyl group, sec-butyl group, t(tert)-butyl group, amyl group, i-amyl group, octyl group, t-octyl group and dodecyl group;

alkenyl groups having about 1 to 12 carbon atoms, such as allyl group, propenyl group and butenyl group;

aryl groups having no substituent, such as phenyl group and naphthyl group, or aryl groups having a substituent (e.g., alkyl group having 1 to 4 carbon atoms), such as methylphenyl group, butylphenyl group, dibutylphenyl group and butylnaphthyl group;

aralkyl groups such as benzyl group, α-methylbenzyl group, α, α'-dimethylbenzyl group, α-butylbenzyl group, phenethyl group and benzhydryl group;

halogens such as fluorine, chlorine and bromine;

and nitro group. Preference is given to t-butyl group and t-octyl group.

A metal compound having an aromatic hydroxycarboxylic acid as a ligand for the present invention can, for example, be obtained by chelating by a commonly known method. More specifically, such a metal compound can, for example, be obtained by adding a metallizing agent to a solution of an aromatic hydroxycarboxylic acid in a sufficient amount of alkali so that the molar ratio of the metal and aromatic hydroxycarboxylic acid is 1:2 to 2:3, heating the mixture, collecting the resulting precipitate by filtration, and washing it.

The counter ion for a metal compound having an aromatic hydroxycarboxylic acid as a ligand for the present invention may be $H^+$, $NH_4^+$, a cation based on an alkali metal (Na, K, etc.), a cation based on an organic amine (aliphatic primary amine, aliphatic secondary amine, aliphatic tertiary amine, etc.), or a quaternary organic ammonium ion.

Although the central metal (M or Me) for a metal compound having an aromatic hydroxycarboxylic acid as a ligand for the present invention may be any metal, metals having a coordination number of 4 or 6 are preferred. Among the preferred metals, greater preference is given to metals divalent or trivalent in atomic valence. Examples thereof include Zn, Sr, Cr, Al, Ti, Fe, Zr, Ni, Co, Mn, boron, Si and Sn. Of these metals, four, namely Zn, Al, Ti and Fe are particularly preferable because of high safety to the human body.

Examples of metallizing agents which can be used to produce the metal compound of the present invention having an aromatic hydroxycarboxylic acid as a ligand include aluminum compounds such as aluminum sulfate and basic aluminum acetate;

chromium compounds such as chromium formate, chromium acetate, chromium sulfate, chromium chloride and chromium nitrate;

iron compounds such as ferric chloride, ferric sulfate and ferric nitrate;

cobalt compounds such as cobalt chloride, cobalt nitrate and cobalt sulfate;

titanium compounds such as titanium chloride; and zinc compounds such as zinc chloride and zinc sulfate.

The charge control agent of the present invention may contain a metal compound having an aromatic hydroxycarboxylic acid as a ligand, as a charge control substance, and the aromatic hydroxycarboxylic acid corresponding to the metal compound's ligand.

In addition, the charge control agent of the present invention may contain one or more metal compounds having an aromatic hydroxycarboxylic acid as a ligand, represented by Formula (I) to (III), and one or more metal compounds having a monoazo compound as a ligand, represented by Formula (IV) or (V), as charge control substances.

Combinations of the aromatic hydroxycarboxylic acid and metal in the metal compound having an aromatic hydroxycarboxylic acid as a ligand, as a charge control substance in the present invention, include, for example, the combinations shown in Table 1. However, these examples are not to be construed as limitative to the present invention.

TABLE 1

| No | Example aromatic hydroxycarboxylic acid | Example metal (M) |
|---|---|---|
| 1 | 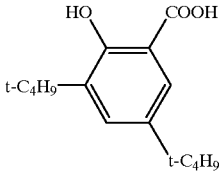 | Fe |
| 2 | 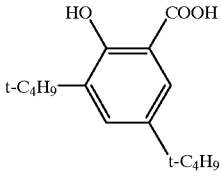 | Cr |
| 3 | 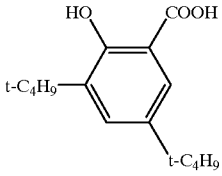 | Al |
| 4 | 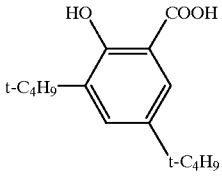 | Zn |
| 5 | 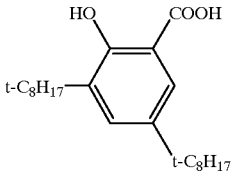 | Fe |
| 6 | 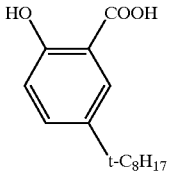 | Al |
| 7 | 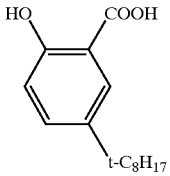 | Fe |
| 8 | 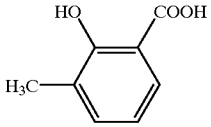 | Al |

TABLE 1-continued

| No | Example aromatic hydroxycarboxylic acid | Example metal (M) |
|---|---|---|
| 9 | 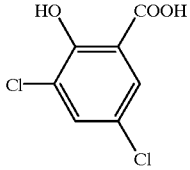 | Fe |
| 10 | 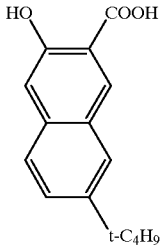 | Al |
| 11 | 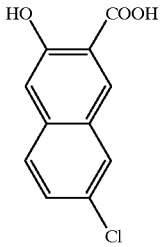 | Fe |
| 12 | 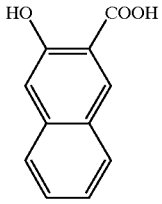 | Al |

Examples of the structure of the metal compound having an aromatic hydroxycarboxylic acid as a ligand for the present invention are given below in the case of aluminum compounds of 3,5-di-t-butylsalicylic acid with $H^+$ serving as the counter ion. However, these examples are not to be construed as limitative to the present invention.

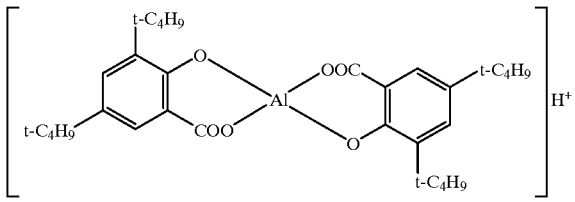

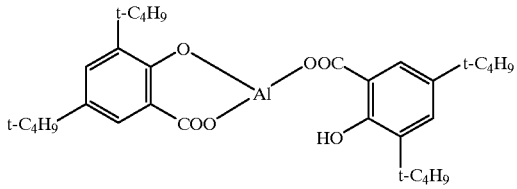

-continued

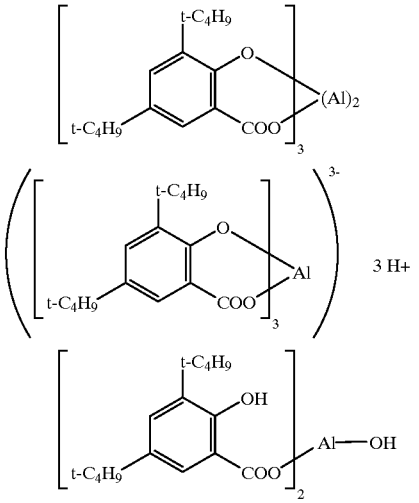

(b) Metal Compounds Having an Aromatic Dicarboxylic Acid as a Ligand

The metal compounds having an aromatic dicarboxylic acid as a ligand of the formula below are preferred from the viewpoint of charge retention, dispersibility in resins for toners, and toner fixability. For this reason, the metal compound having an aromatic dicarboxylic acid as a ligand as the charge control substance constituting the base particle in the present invention preferably comprises a compound of the formula below.

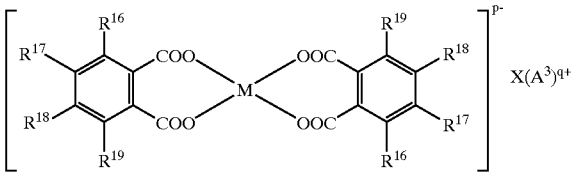

[In this formula, each of $R^{16}$ to $R^{19}$ is H (hydrogen), a hydroxyl group, a normal or branched alkyl group having 1 to 12 carbon atoms, an alkenyl group having about 1 to 12 carbon atoms, a halogen or a nitro group ($R^6$ to $R^9$ may be identical or not);

M is a divalent, trivalent or tetravalent metal;

p is 0, 1 or 2;

q is 1 or 2;

$(A^3)^{q+}$ is $H^+$, $NH_4^+$, a cation based on an alkali metal (Na, K, etc.), a cation based on an organic amine (aliphatic primary amine, aliphatic secondary amine, aliphatic tertiary amine, etc.), or a quaternary organic ammonium ion;

X is 0, 1 or 2.]

Although the central metal M for a metal compound having an aromatic dicarboxylic acid as a ligand for the present invention may be any metal, metals having a coordination number of 4 or 6 are preferred. Among the preferred metals, greater preference is given to metals divalent or trivalent in atomic valence. Examples thereof include Zn, Sr, Cr, Al, Ti, Fe, Zr, Ni, Co, Mn, boron, Si and Sn. Of these metals, four, namely Zn, Al, Ti and Fe are particularly preferable because of high safety to the human body.

Combinations of the aromatic dicarboxylic acid and metal in the metal compound having an aromatic dicarboxylic acid as a ligand, as a charge control substance in the present invention, include, for example, the combinations shown in Table 2. However, these examples are not to be construed as limitative to the present invention.

TABLE 2

| No | Example aromatic dicarboxylic acid | Example metal (M) |
|---|---|---|
| 13 | 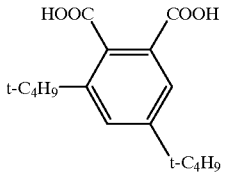 | Fe |
| 14 | 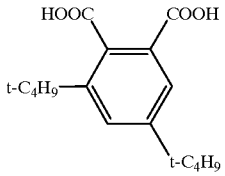 | Cr |
| 15 | 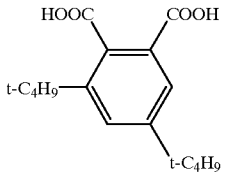 | Al |
| 16 | 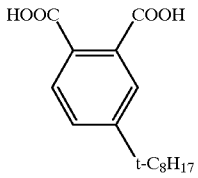 | Zn |
| 17 | 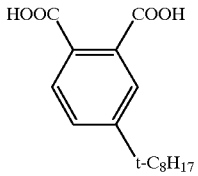 | Fe |
| 18 | 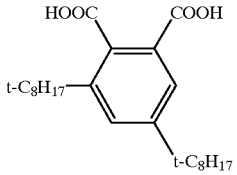 | Al |

(c) Metal Compounds Having a Monoazo Compound as a Ligand

The metal compounds having a monoazo compound as a ligand of Formulas (IV) and (V) below are preferred from the viewpoint of charge retention, dispersibility in resins for toners, and toner fixability. For this reason, the metal compound having a monoazo compound as a ligand as the charge control substance constituting the base particle in the present invention preferably comprises a compound of Formula (IV) below and/or a compound of Formula (V).

(IV)

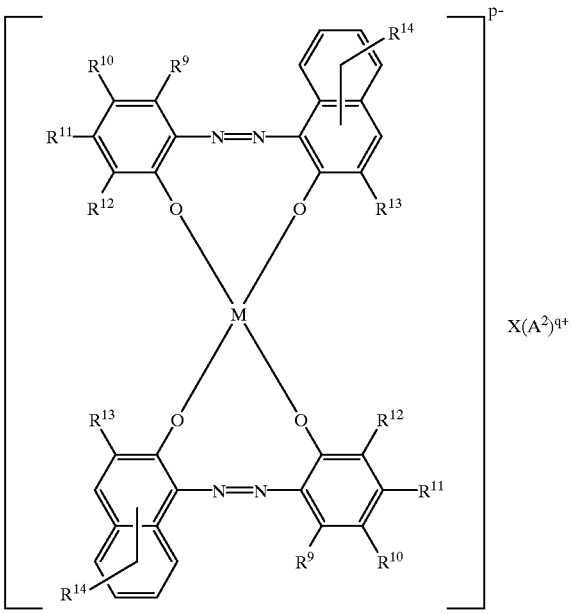

[In Formula (IV), each of $R^9$ to $R^{12}$ and $R^{14}$ is H (hydrogen), a normal or branched alkyl group having 1 to 18 carbon atoms, a normal or branched alkenyl group having 2 to 18 carbon atoms, a sulfonamide group, a mesyl group, a sulfonic acid group, a hydroxyl group, an alkoxy group having 1 to 18 carbon atoms, an acetylamino group, a benzoylamino group, a halogen (atom) or —COO—$R^{15}$ ($R^9$ to $R^{12}$ and $R^{14}$ may be identical or not; $R^{15}$ is a normal or branched alkyl group having 1 to 18 carbon atoms or an aryl group having 6 to 18 carbon atoms);

$R^{13}$ is H (hydrogen), a halogen (atom), a nitro group, a carboxyl group, a normal or branched alkyl group having 1 to 18 carbon atoms, an alkenyl group having 2 to 18 carbon atoms, an alkoxy group having 1 to 18 carbon atoms, an aryl group having 6 to 18 carbon atoms, —COO—$R^{15}$ or

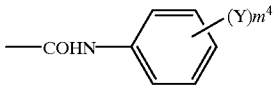

$R^{15}$ is a normal or branched alkyl group having 1 to 18 carbon atoms or an aryl group having 6 to 18 carbon atoms;

Y is H (hydrogen), a normal or branched alkyl group having 1 to 8 carbon atoms, an alkoxy group having 1 to 5 carbon atoms, a nitro group or a halogen;

$m^4$ is 1, 2 or 3;

M is a divalent, trivalent or tetravalent metal;

each of p and X is 0, 1 or 2;

q is 1 or 2;

$(A^2)^{q+}$ is $H^+$, $NH_4^+$, a cation based on an alkali metal (Na, K, etc.), a cation based on an organic amine (aliphatic primary amine, aliphatic secondary amine, aliphatic tertiary amine, etc.), or a quaternary organic ammonium ion.]

(V)

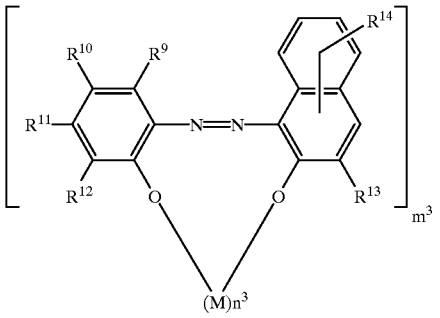

[In Formula (V), each of $R^9$ to $R^{12}$ and $R^{14}$ is H, a normal or branched alkyl group having 1 to 18 carbon atoms, a normal or branched alkenyl group having 2 to 18 carbon atoms, a sulfonamide group, a mesyl group, a sulfonic acid group, a hydroxyl group, an alkoxy group having 1 to 18 carbon atoms, an acetylamino group, a benzoylamino group, a halogen (atom) or —COO—$R^{15}$ ($R^9$ to $R^{12}$ and $R^{14}$ may be identical or not; $R^{15}$ is a normal or branched alkyl group having 1 to 18 carbon atoms or an aryl group having 6 to 18 carbon atoms); $R^{13}$ is H, a halogen (atom), a nitro group, a carboxyl group, a normal or branched alkyl group having 1 to 18 carbon atoms, an alkenyl group having 2 to 18 carbon atoms, an alkoxy group having 1 to 18 carbon atoms, an aryl group having 6 to 18 carbon atoms, —COO—$R^{15}$ or

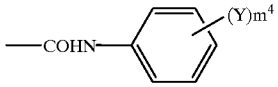

$R^{15}$ is a normal or branched alkyl group having 1 to 18 carbon atoms or an aryl group having 6 to 18 carbon atoms;

Y is H (hydrogen), a normal or branched alkyl group having 1 to 8 carbon atoms, an alkoxy group having 1 to 5 carbon atoms, a nitro group or a halogen;

$m^3$ is an integer of 3 or more;

$n^3$ is an integer of 1 or more;

$m^4$ is 1, 2 or 3;

M is a divalent or trivalent metal.]

Examples of combinations of $m^3$ and $n^3$ above include the combination wherein $m^3$ is 3 and $n^3$ is 1, the combination wherein $m^3$ is 3 and $n^3$ is 2, and the combination wherein $m^3$ is 6 and $n^3$ is 2.

Although the central metal (M) for a metal compound having a monoazo compound as a ligand for the present invention may be any metal, metals having a coordination number of 4 or 6 are preferred. Among the preferred metals, greater preference is given to metals divalent or trivalent in atomic valence. Examples thereof include Zn, Sr, Cr, Al, Ti, Fe, Zr, Ni, Co, Mn, boron, Si and Sn. Of these metals, four, namely Zn, Al, Ti and Fe are particularly preferable because of high safety to the human body.

The charge control agent of the present invention may contain a metal compound having a monoazo compound as a ligand, as a charge control substance, and the monoazo compound corresponding to the metal compound's ligand.

Combinations of the monoazo compound and metal in the metal compound having a monoazo compound as a ligand, as a charge control substance in the present invention, include, for example, the combinations shown in Table 3. However, these examples are not to be construed as limitative to the present invention.
TABLE 3
| No | Monoazo compound of the present invention | metal (M) |
|---|---|---|
| 19 | 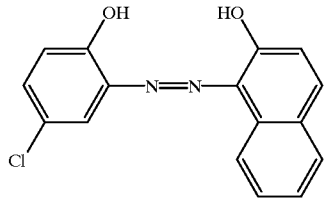 | Fe |
| 20 | 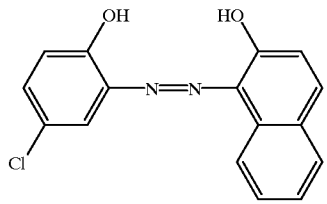 | Cr |
| 21 | 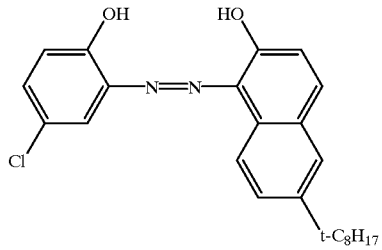 | Fe |
| 22 | 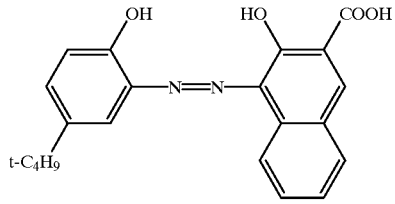 | Cr |
| 23 | 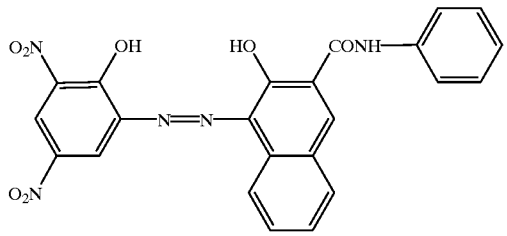 | Fe |
| 24 | 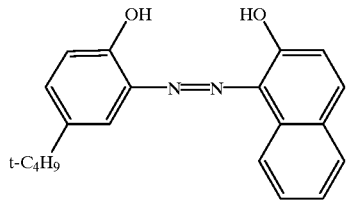 | Cr |

TABLE 3-continued

| No | Monoazo compound of the present invention | metal (M) |
|---|---|---|
| 25 | 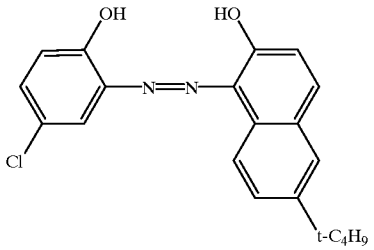 | Fe |
| 26 | 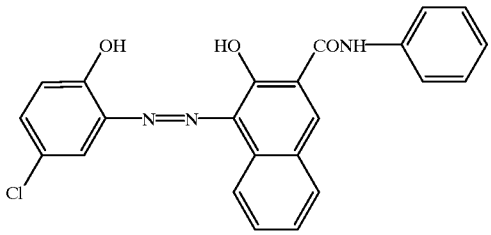 | Cr |
| 27 | 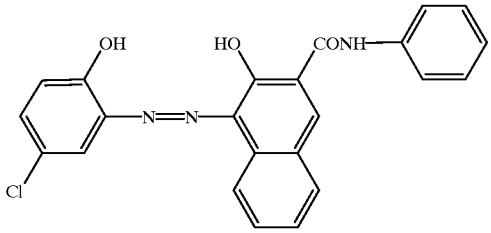 | Fe |
| 28 | 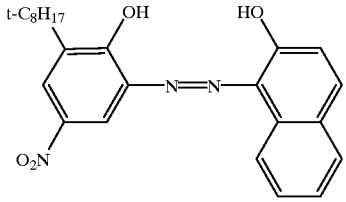 | Fe |

(d) Calix(n)arenes

The cyclic compounds composed of one or more species of the component units respectively represented by Formulas (VI) to (IX) below [calix(n)arenes] are preferred from the viewpoint of charge retention, dispersibility in resins for toners, and toner fixability. For this reason, the calix(n)arene as the charge control substance constituting the base particle in the present invention preferably comprises a cyclic compound composed of one or more species of the component units respectively represented by Formulas (VI) to (IX) below [the component units in parentheses in Formulas (VI) to (IX) are capable of bonding in any order], or a mixture of several species of the cyclic compound.

(VI)

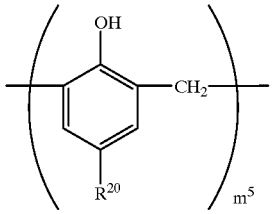

(VII)

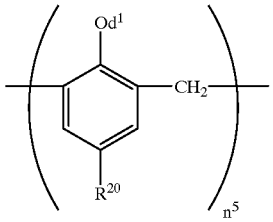

-continued (VIII)

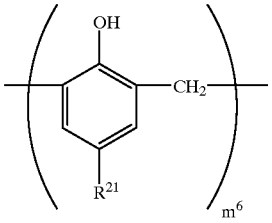

(IX)

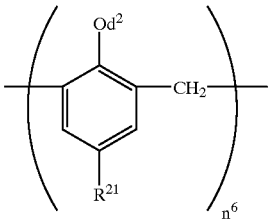

[In the formulas above, each of $R^{20}$ and $R^{21}$ is H (hydrogen), a halogen, a normal or branched alkyl group having 1 to 18 carbon atoms; a phenyl group having or not having a substituent (e.g., alkyl group having 1 to 4 carbon atoms); an alkoxy group (e.g., those having 1 to 4 carbon atoms); an alicyclic group (e.g., cycloalkyl groups having 3 to 8 carbon atoms, such as cyclohexyl, cycloheptyl and cyclooctyl); a normal or branched alkenyl group (e.g., those having 1 to 8 carbon atoms); or an aralkyl group (benzyl group, α-methylbenzyl group, α, α'-dimethylbenzyl group, α-butylbenzyl group, phenethyl group, benzhydryl group, etc.) ($R^{20}$ and $R^{21}$ may be identical or not), each of $d^1$ and $d^2$ is H (hydrogen), an alkali metal, ammonium or organic ammonium ($d^1$ and $d^2$ may be identical or not), $m^5$ is an integer of 1 or more, $n^5$ is an integer of 0 to 2, $m^6$ is an integer of 1 or more, $n^6$ is an integer of 0 to 2, $m^5+n^5+m^6+n^6$ is an integer of 3 to 8.]

Examples of calix(n)arenes serving as a charge control substance in the present invention are shown in Table 4, with the structural formulas of Example Compounds 29, 33, 36 and 38 given in the same table. However, these examples are not to be construed as limitative to the present invention.

TABLE 4

| No | $R^{20}$ | $R^{21}$ | $d^1$ | $d^2$ | $m^5$, $n^5$, $m^6$, $n^6$ |
|---|---|---|---|---|---|
| 29 | t-$C_4H_9$ | — | H | — | $m^5 = 8$, $n^5$, $m^6$, $n^6 = 0$ |
| 30 | t-$C_4H_9$ | t-$C_4H_9$ | K | K | $m^5 + n^5 + m^6 = 7$, $n^6 = 1$ |
| 31 | t-$C_4H_9$ | — | H | — | $m^5 = 6$, $n^5$,$m^6$, $n^6 = 0$ |
| 32 | $OCH_3$ | — | H | — | $m^5 = 8$, $n^5$, $m^6$, $n^6 = 0$ |
| 33 | Phenyl | — | H | — | $m^5 = 8$, $n^5$, $m^6$, $n^6 = 0$ |
| 34 | $C_8H_{17}$ | — | H | — | $m^5 = 8$, $n^5$, $m^6$, $n^6 = 0$ |
| 35 | Phenylisopropyl | — | H | — | $m^5 = 6$, $n^5$,$m^6$, $n^6 = 0$ |
| 36 | t-$C_4H_9$ | Phenyl | H | H | $m^5 + n^5 + m^6 + n^6 = 3$ to 8 |
| 37 | t-$C_4H_9$ | $C_8H_{17}$ | Na | Na | $m^5 + n^5 + m^6 + n^6 = 3$ to 8 |
| 38 | t-$C_4H_9$ | $C_8H_{17}$ | K | K | $m^5 + n^5 + m^6 + n^6 = 3$ to 8 |

Example Compound 29

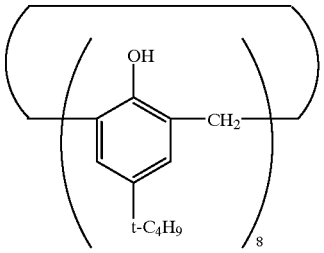

Example Compound 33

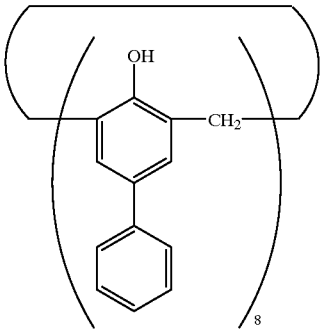

Example Compound 36

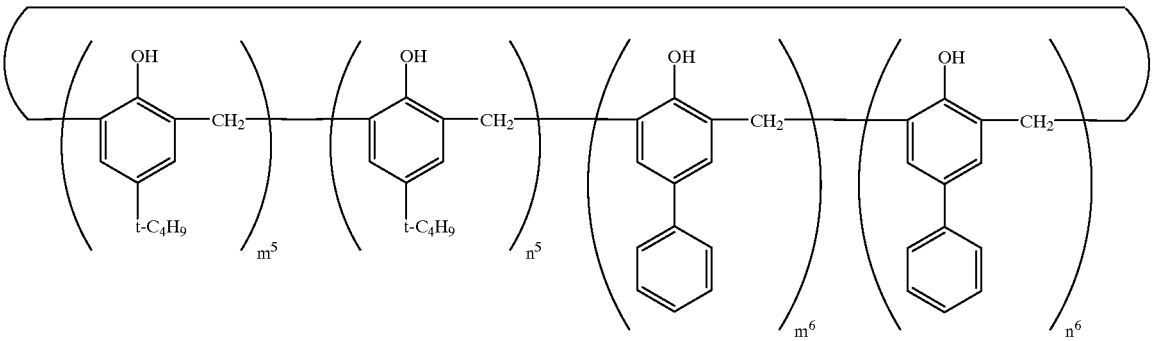

Example Compound 38

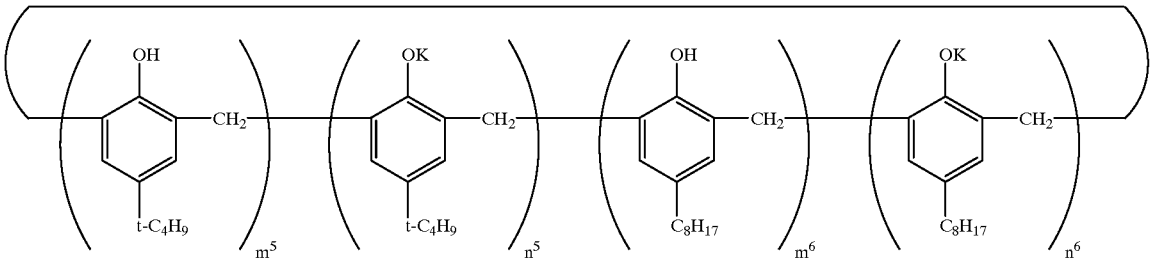

(e) Quaternary Ammonium Salt Compounds

The quaternary ammonium salt compounds of the structure shown below are preferred from the viewpoint of charge retention, dispersibility in resins for toners, and toner fixability. For this reason, the quaternary ammonium salt compound as the charge control substance constituting the base particle in the present invention preferably comprises a compound of the formula below.

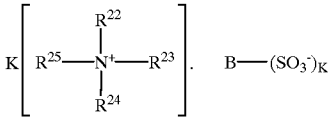

[In the formula above, each of $R^{22}$, $R^{23}$, $R^{24}$ and $R^{25}$ is a normal or branched alkyl group having 1 to 18 carbon atoms, and having or not having a substituent; a normal or branched alkenyl group (e.g., those having 1 to 8 carbon atoms); a cycloalkyl group (e.g., those having 3 to 18 carbon atoms); a phenyl group having or not having a substituent; or a benzyl group having or not having a substituent ($R^{22}$, $R^{23}$, $R^{24}$ and $R^{25}$ may be identical or not), $B—(SO_3^-)_K$ is an anion based on a benzenesulfonic acid derivative or naphthalenesulfonic acid derivative having K sulfone groups; K is an integer of 1 to 3.]

In consideration of compound stability and melting point, this quaternary ammonium salt compound is more preferably a quaternary ammonium salt compound of the structural formula below.

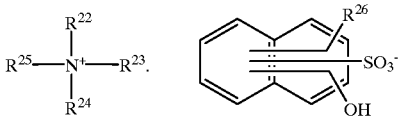

[In the formula above, each of $R^{22}$, $R^{23}$, $R^{24}$ and $R^{25}$ is a normal or branched alkyl group having 1 to 18 carbon atoms, and having or not having a substituent; a normal or branched alkenyl group (e.g., those having 1 to 8 carbon atoms); a cycloalkyl group (e.g., those having 3 to 8 carbon atoms); a phenyl group having or not having a substituent; or a benzyl group having or not having a substituent ($R^{22}$, $R^{23}$, $R^{24}$ and $R^{25}$ may be identical or not), $R^{26}$ is a hydroxyl group, a halogen, a normal or branched alkyl group having or not having a substituent (e.g., those having 1 to 4 carbon atoms), or a COOH group.]

Examples of the aforementioned normal or branched alkyl group having 1 to 18 carbon atoms, and having or not having a substituent, include methyl group, ethyl group, n-propyl group, i-propyl group, n-butyl group, i-butyl group, t-butyl group, n-pentyl group, t-pentyl group, hexyl group, heptyl group, octyl group, nonyl group and dodecyl group; and hydroxy-substituted alkyl groups, halogen-substituted alkyl groups and alkoxyl-substituted alkyl groups (specifically 2-hydroxyethyl group, hydroxymethyl group, methoxymethyl group, cyanomethyl group, formylmethyl group, chloromethyl group, 2-chloroethyl group, 4-carboethoxybutyl group, carbomethoxymethyl group, 4-carboxybutyl group, etc.). Preference is given to butyl group and octyl group.

Examples of the aforementioned alkenyl group include vinyl group, allyl group, propenyl group and butenyl group.

Examples of the aforementioned cycloalkyl group include cyclopropyl, cyclopentyl, cyclohexyl and cycloheptyl.

Examples of the aforementioned phenyl group having or not having a substituent include phenyl group, and substituted phenyl groups such as hydroxy-substituted phenyl groups, halogen-substituted phenyl groups, nitro-substituted phenyl groups and alkoxyl-substituted phenyl groups (specifically 2-methylphenyl group, 3-methylphenyl group, 4-methylphenyl group, 4-t-butylphenyl group, 4-t-octylphenyl group, 4-methoxyphenyl, 4-ethoxyphenyl group, 4-n-butoxyphenyl group, 2-hydroxyphenyl group, 4-bromophenyl group, 4-chlorophenyl group, 4-fluorophenyl group, 2-nitrophenyl group, 4-nitrophenyl group, 4-cyanophenyl group, p-phenylphenyl group, p-naphthylphenyl group, etc.).

Examples of the aforementioned benzyl group having or not having a substituent include benzyl group, and benzyl groups substituted by lower alkyl groups (1 to 4 carbon atoms), nitro-substituted benzyl groups and halogen-substituted benzyl groups (specifically benzyl group, 2-methylbenzyl group, 3-methylbenzyl group, 4-methylbenzyl group, 4-methoxybenzyl group, 4-n-butoxybenzyl group, 4-ethoxybenzyl group, 2-hydroxybenzyl group, 4-bromobenzyl group, 4-chlorobenzyl group, 4-fluorobenzyl group, 2-nitrobenzyl group, 4-nitrobenzyl group, 4-cyanobenzyl, naphthylbenzyl group, etc.). Preference is given to benzyl group.

Examples of the quaternary ammonium salt compound of the formula below (same as above) as the charge control substance in the present invention are given in Table 5. However, these examples are not to be construed as limitative to the present invention.

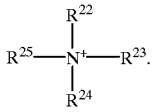

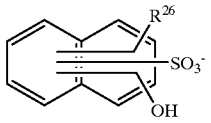

TABLE 5

| No | $R^{22}$ | $R^{23}$ | $R^{24}$ | $R^{25}$ | Anion based on naphthalenemonosulfonic acid derivative |
|---|---|---|---|---|---|
| 39 | n-$C_4H_9$ | Benzyl | n-$C_4H_9$ | n-$C_4H_9$ | 1-Naphthol-4-sulfonic acid ion |
| 40 | n-$C_4H_9$ | n-$C_4H_9$ | n-$C_4H_9$ | n-$C_4H_9$ | 1-Naphthol-4-sulfonic acid ion |
| 41 | i-$C_4H_9$ | Benzyl | $CF_3$—$C_{12}H_{24}$ | i-$C_4H_9$ | 2-Carboxy-1-naphthol-5-sulfonic acid ion |
| 42 | n-$C_4H_9$ | o-Octylphenyl | n-$C_4H_9$ | n-$C_4H_9$ | 2-Hydroxy-1-naphthol-5-sulfonic acid ion |
| 43 | n-$C_8H_{17}$ | Benzyl | n-$C_8H_{17}$ | Phenyl | 8-Hydroxy-1-naphthol-4-sulfonic acid ion |
| 44 | $CH_3$ | i-$C_4H_9$ | $C_2H_5$ | t-$C_8H_{17}$ | 2-Carboxy-1-naphthol-5-sulfonic acid ion |
| 45 | n-$C_4H_9$ | o-Chlorophenyl | n-$C_4H_9$ | n-$C_4H_9$ | 7-Butyl-1-naphthol-4-sulfonic acid ion |
| 46 | n-$C_8H_{17}$ | Benzyl | n-$C_8H_{17}$ | n-$C_8H_{17}$ | 1-Naphthol-4-sulfonic acid ion |

The toner of the present invention for developing electrostatic images contains the aforementioned charge control agent for the purpose of charge control, and also contains a coloring agent and a resin. It is desirable that this toner for developing electrostatic images be such that base particles are dispersed in the resin.

The toner of the present invention for developing electrostatic images can serve well, as long as the aforementioned charge control agent of the present invention is contained in an amount enabling the control of the toner charge. Preferable amounts of charge control agent added are 0.1 to parts by weight, more preferably 0.5 to 5 parts by weight, per 100 parts by weight of the resin for the toner.

From the viewpoint of toner fixability on paper, offset resistance to rollers, toner blocking resistance during storage, etc., resins for toners are usually required to have an appropriate hot melt property, elasticity, fluidity, etc. Examples of resins useful in the toner of the present invention include the following synthetic resins known as resins for toners or binder resins. Specifically, useful resins include styrene resin, styrene-acrylic resin, styrene-butadiene resin, styrene-maleic acid resin, styrene-vinyl methyl ether resin, styrene-methacrylate copolymer, phenol resin, epoxy resin, polyester resin, polypropylene resin and paraffin wax. These resins may be used singly or in blends of several kinds.

As coloring agents for black toners, carbon black for coloring (coloring black) at acidic to basic pH levels is normally used. Such kinds of carbon black include, for example, those commercially available under the trade names MA100, MA11, MA8, MA7, #40 and #44 (all produced by Mitsubishi Chemical Corporation); Raven 1250 (produced by Columbian Carbon); Monarck 880, Mogul L and Mogul 660R (all produced by Cabot Corporation); and Color Black FW2, Special Black 250 and Printex 90 (all produced by Degussa Japan Co., Ltd.). As long as the accomplishment of the expected object of the present invention is not interfered with, various dyes and pigments can also be used.

As coloring agents for color toners, various dyes and pigments can be used as necessary. Examples thereof include organic pigments such as Quinophthalone Yellow, Hansa Yellow, Isoindolinone Yellow, Perinone Orange, Perylene Maroon, Rhodamine 6G Lake, Quinacridone, Anthanthron Red, Rose Bengale, Copper Phthalocyanine Blue, Copper Phthalocyanine Green and diketopyrrolopyrrole pigments; and inorganic pigments such as Titanium White, Titanium Yellow, Ultramarine, Cobalt Blue and red iron oxide. Such coloring agents can be used singly or in combination of two or more kinds.

Also, to improve toner quality, additives, e.g., anti-offset agents, fluidity-improving agents and cleaning aids, can be added internally or externally.

Anti-offset agents (releasing agents) used to improve toner fixability as described above include various waxes, particularly those having average molecular weights of 500 to 15000. Specifically, there can be used polyolefin type waxes such as low molecular polypropylene, polyethylene, oxidized polypropylene and oxidized polyethylene; and natural waxes such as carnauba wax, rice wax and montan wax.

Useful fluidity-improving agents as described above include various metal oxides such as silica, aluminum oxide and titanium oxide, and magnesium fluoride.

Useful cleaning aids as described above include metal soaps of stearic acid etc.; and various synthetic resin fine particles such as fluorine, silicon or styrene-(meth)acrylic synthetic resin fine particles.

Also, according to the mode of developing electrostatic images using the toner of the present invention, electroconductive substances (e.g., electroconductive carbon black, graphite), magnetic fine particles [e.g., ferromagnetic fine particles such as those of ferromagnetic metals (e.g., iron, cobalt, nickel), various alloys, oxides thereof (ferrite etc.)], etc., can be added to the toner.

The toner of the present invention for developing electrostatic images can, for example, be produced as described below. Specifically, a toner having a mean particle diameter of 5 to 20 $\mu$m can be obtained by thoroughly mixing the aforementioned granulated charge control agent, a resin for a toner, and a coloring agent, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, then pulverizing the solid and classifying the resulting particles by size.

Other applicable methods include the method in which starting materials are dispersed in a toner resin solution and subsequently spray dried to yield the desired toner, and the polymerization method in which a given set of starting materials are mixed in a monomer to constitute a resin for a toner to yield an emulsified suspension, which is then polymerized to yield the desired toner.

When the toner of the present invention for developing electrostatic images is used as a two-component developer, development can be achieved by the two-component magnetic brush developing process or the like using the toner of the present invention in mixture with carrier powder.

Useful carrier include, but are not limited to, commonly known carrier. Examples of the carrier include iron powder, nickel powder, ferrite powder and glass beads about 50 to 200 μm in particle diameter, and such materials as coated with acrylate copolymer, styrene-acrylate copolymer, styrene-methacrylate copolymer, silicone resin, polyamide resin, ethylene fluoride resin or the like.

When the toner of the present invention for developing electrostatic images is used as a one-component developer, a fine powder of a ferromagnetic material, such as iron powder, nickel powder or ferrite powder, may be added and dispersed in preparing the toner as described above. Examples of developing processes which can be used in this case include contact development and jumping development.

On the other hand, by adding the granulated charge control agent of the present invention to a resin powder paint for electrostatic painting, the charge of the powder paint can be controlled or enhanced. Because resin powder paints for electrostatic painting containing the charge control agent of the present invention is excellent in heat resistance and good in charge-enhancing characteristic, they exhibit high paint adhesion efficiency even without recycled use. Painting using such a powder paint can be achieved by an ordinary electrostatic powder painting method such as the corona application method, the frictional charging method or the hybrid method.

It is also possible to obtain a frictional charge-providing element capable of providing a charge for a toner for developing electrostatic images by coating the surface of a carrier, a cylindrical sleeve of a toner transportation element or a doctor blade, with the granulated charge control agent of the present invention, by dipping, spraying, brush application or the like. This frictional charge-providing element is capable of stably providing a charge for a toner and producing toner images of high quality comparable to that of initial images even after continuous copying.

EXAMPLES

The present invention is hereinafter described in more detail by means of the following examples, which are not to be construed as limitative. In the description below, "part(s) by weight" is referred to as "part(s)" for short.

In Production Examples 1 to 8, examples of manufacturing of the charge control agent of the present invention are described.

Production Example 1

Synthesis of Example Compound 1

Zinc 3,5-di-t-butylsalicylate compound (charge control substance produced by Orient Chemical Industries, Ltd., trade name BONTRON E-84) 91.0 parts by weight Styrene-maleic anhydride copolymer alkyl ester ammonium salt [degree of esterification 15%] (granulating agent) 4.5 parts by weight Gelatin (granulating agent) 4.5 parts by weight Water 300 parts by weight After the above ingredients were milled in an aqueous system using a sand mill so that the mean particle diameter of the zinc 3,5-di-t-butylsalicylate compound became 2.4 μm, spray drying was conducted to yield a granulated powder 12 μm in mean particle diameter (mean minor/major axial diameter ratio 0.9 to 1.0).

The mean particle diameters in Production Examples 1 to 8 were determined using a laser diffraction/scattering particle size analyzer (LA-920 produced by Horiba, Ltd.).

Production Example 2

Synthesis of Example Compound 2

Aluminum 3,5-di-t-butylsalicylate compound (charge control substance produced by Orient Chemical Industries, Ltd., trade name BONTRON E-88) 91.0 parts by weight Styrene-maleic anhydride copolymer alkyl ester ammonium salt [degree of esterification 20%] (granulating agent) 4.5 parts by weight Sodium dodecyl benzenesulfonate (granulating agent) 4.5 parts by weight Water 230 parts by weight After the above ingredients were dispersed using a paint shaker, spray drying was conducted to yield a granulated powder 38 μm in mean particle diameter (mean minor/major axial diameter ratio 0.9 to, 1.0).

Production Examples 3 to 8

The same treatment as in Production Example 1 was conducted, except that the ingredients were replaced with the compounds shown in Table 6 below, to yield granulated powders of the respective mean particle diameters and mean minor/major axial diameter ratios shown in Table 6.

TABLE 6

| | | Production Example 3 | Production Example 4 | Production Example 5 | Production Example 6 | Production Example 7 | Production Example 8 |
|---|---|---|---|---|---|---|---|
| Pre-granulation Compounds (parts by weight) | Zinc 3,5-di-t-butylsalicylate compound No. 4 | | | | 85.0 | | |
| | Aluminum 3,5-di-t-butylsalicylate compound No. 3 | | | | | 45.0 | |
| | Iron 3,5-di-t-butylsalicylate compound No. 1 | | | | | | 91.0 |
| | Monoazo dye-chromium complex No. 20 | 85.0 | | | | | |
| | Benzyltriethyl-ammonium-4-hydroxy-naphthalene-2-sulfonate | 5.0 | | 93.0 | | | |
| | Monoazo dye-iron compound No. 21 | | 91.0 | | | | |
| | t-Butylcalix(8)arene No. 29 | | | | | 45.0 | |
| Granulating agents (parts by weight) | Sodium α-olefinsulfonate | 5.0 | | | 5.0 | | |
| | Ammonium dioctylsulfosuccinate | | | 1.0 | | | 3.0 |
| | Sodium dodecyl benzenesulfonate | | 2.0 | | | | |

TABLE 6-continued

| | | Production Example 3 | Production Example 4 | Production Example 5 | Production Example 6 | Production Example 7 | Production Example 8 |
|---|---|---|---|---|---|---|---|
| | Polyoxyethylene polyoxypropylene glycol | | 3.0 | | | 4.0 | |
| | Methyl cellulose | | 4.0 | | | 6.0 | |
| | Casein | 5.0 | | | | | 6.0 |
| | Polyvinyl alcohol | | | | 10.0 | | |
| | Sodium polyacrylate | | | 6.0 | | | |
| Shape | Mean particle diameter ($\mu$m) | 26.7 | 38.0 | 15.2 | 32.5 | 26.6 | 13.0 |
| | Mean minor/major axial diameter Ratio | 0.90 to 1.00 | 0.95 to 1.00 | 0.82 to 1.00 | 0.95 to 1.00 | 0.80 to 1.00 | 0.93 to 1.00 |

In Examples 1 to 5, toners of the present invention for developing electrostatic images, excluding polymerized toners, are described.

Example 1

Styrene-acrylic copolymer resin (produced by Sanyo Kasei Co., Ltd., trade name HIMER SMB-600) . . . 100 parts Low polymer polypropylene (produced by Sanyo Kasei Co., Ltd., trade name Biscal 550P) . . . 5 parts Carbon Black (produced by Mitsubishi Chemical Co., Ltd., trade name MA100) . . . 7 parts Charge control agent (granulated powder obtained in Production Example 1) . . . 3 parts The above ingredients were uniformly pre-mixed using a high-speed mixer to yield a premix, which was then kneaded in a molten state using a heat roll, cooled and thereafter roughly milled using an ultracentrifugal mill. The rough milling product obtained was finely pulverized using an air jet mill equipped with a mechanical classifier to yield a black toner 5 to 15 $\mu$m in particle diameter.

Five parts of this toner was admixed with 95 parts of an iron powder carrier to yield a developer. The amount of blowoff charges of this developer was determined over time (Toshiba Chemical TB-200 analyzer used). The results of determination are shown in FIG. 1.

The amount of saturated charges of this developer was −28.2 $\mu$C/g and was stable at under low-temperature low-humidity conditions and under high-temperature high-humidity conditions, demonstrating good storage stability.

When this toner was used to repeatedly form toner images in 20,000 copies using a commercial copying machine, the charge stability and retention were good, and high-quality black images with no offset phenomenon, image density reduction or fogging were obtained.

The time t (min) after mixing initiation, the amount of charges [q($\mu$C/g)] at time t, and the amount of saturated charges [qe($\mu$C/g)] were substituted in the equation shown below, and the charge rise constant k (indicates the charge rise speed) was calculated from the gradient of the plot.

$$\ln \frac{qe - q}{qe} = -kt$$

Figure 2:
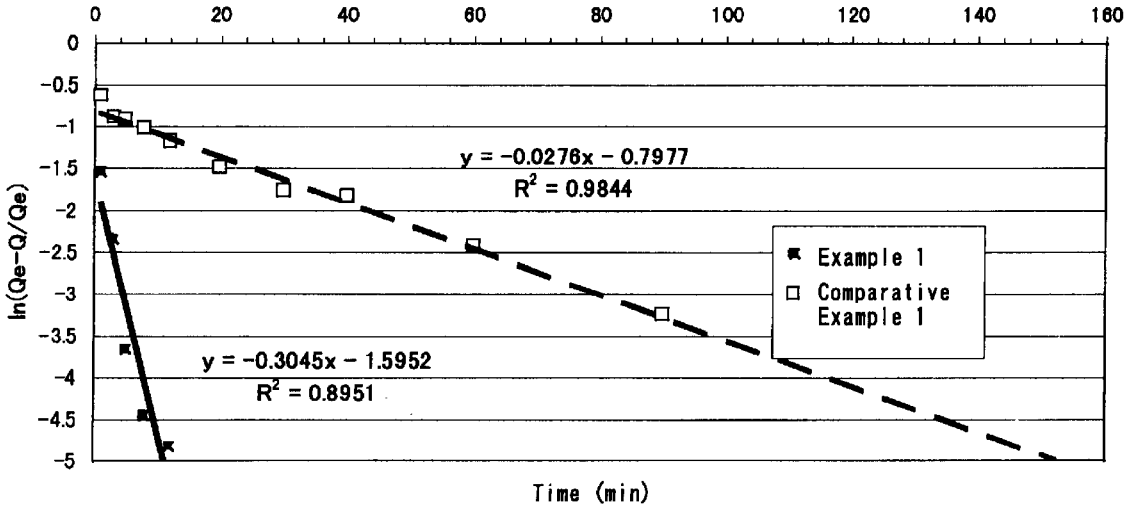
FIG. 2 is a diagram showing the charge rise characteristics of the toners obtained in Example 1 and Comparative Example 1.

The amount of saturated charges and rise constant k value for the toner obtained are shown in Table 7; the temporal changes in the amount of charges are shown in FIG. 1; the charge rise line is shown in FIG. 2.

TABLE 7

| | Charge control agent | Amount of charges $\mu$C/g | Rise constant k |
|---|---|---|---|
| Example 1 | Production Example 1 | −28.2 | 0.305 |
| Example 2 | Production Example 2 | −30.3 | 0.090 |
| Example 3 | Production Example 3 | −41.1 | 0.257 |
| Example 4 | Production Example 4 | −38.6 | 0.070 |
| Example 5 | Production Example 5 | +14.7 | 0.108 |
| Example 6 | Production Example 6 | −26.3 | 0.077 |
| Example 7 | Production Example 3 | −48.2 | 0.091 |
| Example 8 | Production Example 5 | +46.0 | 0.063 |
| Comparative Example 1 | Compound 4 | −34.3 | 0.027 |
| Comparative Example 2 | Compound 3 | −36.0 | 0.021 |

Example 2

Styrene resin (produced by Esso Sekiyu Kagaku Co., Ltd., trade name BICOLASTIC D-125) . . . 100 parts Low polymer polypropylene (produced by Sanyo Kasei Co., Ltd., trade name Biscal 550P) . . . parts Copper phthalocyanine pigment . . . 7 parts Charge control agent (granulated powder obtained in Production Example 2) . . . 3 parts The above ingredients were treated in the same manner as in Example 1 to yield a blue toner.

Five parts of this toner was admixed with 95 parts of an iron powder carrier to yield a developer. The amount of blowoff charges of this developer was determined over time (Toshiba Chemical TB-200 analyzer used). The results of determination are shown in FIG. 3.

The amount of charges of this developer was −30.3 $\mu$C/g and was stable at under low-temperature low-humidity conditions and under high-temperature high-humidity conditions, demonstrating good storage stability.

When this toner was used to form toner images using a commercial copying machine, fogging-free high-quality blue images with good thin line reproducibility were obtained. Even after 20,000 copies were continuously taken, good blue images were obtained with no image density reduction or offset phenomenon.

Figure 3:
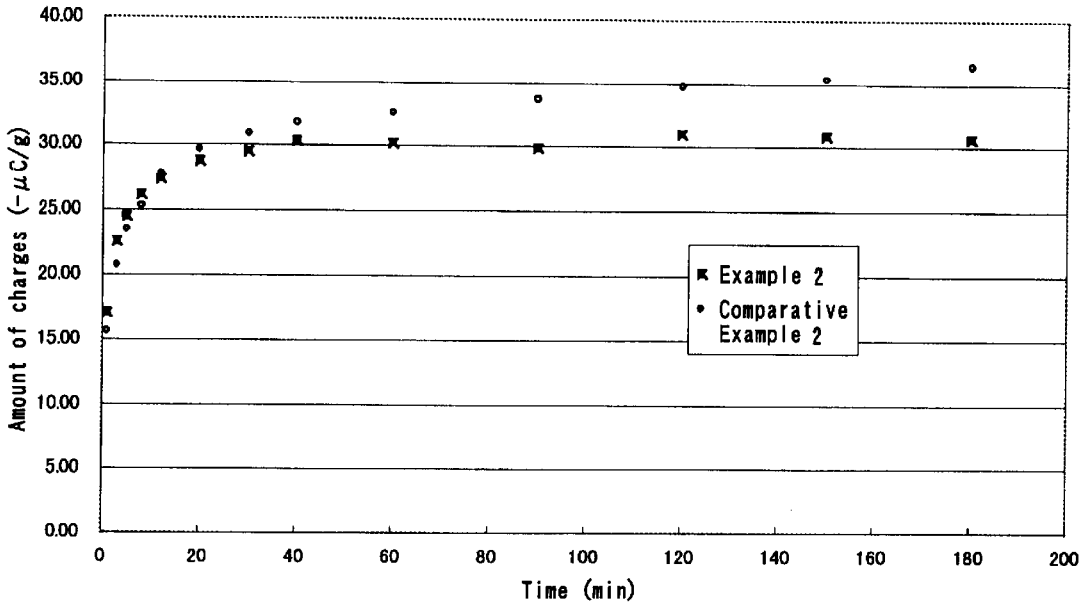
FIG. 3 is a diagram showing temporal changes in the amounts of charges for the toners obtained in Example 2 and Comparative Example 2.
Figure 4:
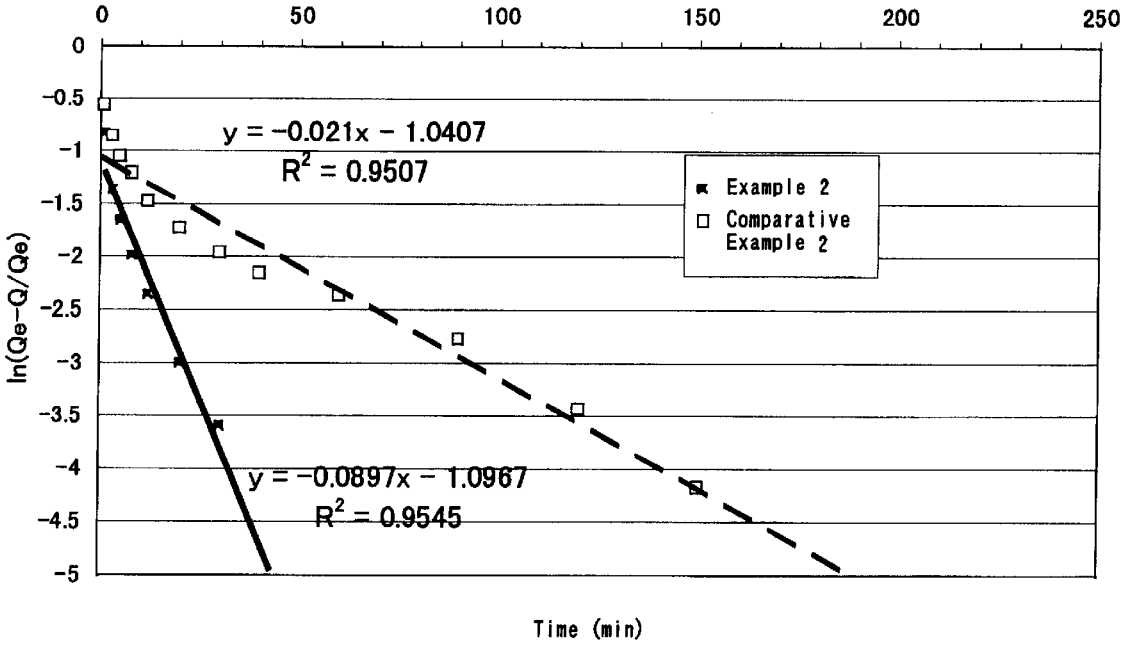
FIG. 4 is a diagram showing the charge rise characteristics of the toners obtained in Example 2 and Comparative Example 2.

As in Example 1, the amount of saturated charges and rise constant k value for the toner obtained are shown in Table 7; the temporal changes in the amount of charges are shown in FIG. 3; the charge rise line is shown in FIG. 4.

Examples 3 to 5

In Examples 3 to 5, toners of the present invention and developers were prepared and evaluated in the same manner as Example 1, except that the charge control agent used in Example 1 (obtained in Production Example 1) was replaced with the various Example Products shown in Table 7. When toner images were repeatedly taken in the same manner as in Example 1, the charge stability and retention were good, and high-quality black images with no offset phenomenon, image density reduction or fogging were obtained.

As in Example 1, the amounts of saturated charges and rise constant k values for the toners obtained are shown in Table 7.

In Examples 6 to 8, polymerized toners containing the granulated charge control agent of the present invention are described.

Example 6

Styrene . . . 60 parts
n-Butyl methacrylate . . . 60 parts
Carbon Black (MA-100, produced by Mitsubishi Chemical Co., Ltd.) . . . 5 parts
2,2'-Azobisisobutyronitrile . . . 1.8 parts
Charge control agent (granulated powder obtained in Production Example 6) . . . 1 part The above ingredients were stirred and mixed at a rotation rate of 3,500 rpm using the TK Homo-mixer (produced by Tokushu Kika Kogyo), a mechanical mixer having high shearing power, to yield a polymerizable monomer composition wherein base particles containing a charge control substance are uniformly dispersed.

Separately, 100 ml of an aqueous solution of sodium tertiary phosphate at a concentration of 0.1 mol % was diluted with 600 ml of distilled water. While stirring this solution, 18.7 ml of an aqueous solution of calcium chloride at a concentration of 1.0 mol/l (liter) was added little by little, after which 0.15 g of an aqueous solution of sodium dodecyl benzenesulfonate at a concentration of 20% was added, to yield a dispersion liquid.

This dispersion liquid was added to the aforementioned dispersing medium (polymerizable monomer composition wherein base particles containing a charge control substance are uniformly dispersed). While stirring at a rotation rate of 3,500 rpm using the TK Homo-mixer (produced by Tokushu Kika Kogyo), the dispersion liquid was heated to a temperature of 65° C. After being continued for a 30-minute period following the temperature rise, this stirring was switched to another mode of stirring at a rotation rate of 100 rpm using an ordinary mechanical stirrer, and polymerization was performed at a constant temperature of 65° C. for 6 hours.

After completion of polymerization, the reaction mixture was cooled, the resulting solid was separated by filtration, and the cake filtered out was immersed in an aqueous solution of hydrochloric acid at a concentration of 5% to decompose the calcium phosphate used as the dispersing agent. The solid was then washed with water until the washing solution became neutral, dehydrated, and dried, to yield a toner 13 $\mu$m in mean particle diameter.

Five parts of this toner was admixed with 95 parts of an iron powder carrier to yield a developer. The amount of blowoff charges of this developer was determined (Toshiba Chemical TB-200 analyzer used). The amount of charges was −28.2 $\mu$C/g and was stable at under low-temperature low-humidity conditions and under high-temperature high-humidity conditions, demonstrating good storage stability.

When this toner was used to repeatedly form toner images in 20,000 copies using a commercial copying machine, the charge stability and retention were good, and high-quality images with no offset phenomenon, image density reduction or fogging were obtained.

As in Example 1, the amount of saturated charges and rise constant k value for the toner obtained are shown in Table 7.

Examples 7 and 8

In Examples 7 and 8, toners of the present invention and developers were prepared and evaluated in the same manner as Example 6, except that the charge control agent used in Example 6 (obtained in Production Example 6) was replaced with the various Example Products shown in Table 7. When toner images were repeatedly taken in the same manner as in Example 6, the charge stability and retention were good, and high-quality black images with no offset phenomenon, image density reduction or fogging were obtained. The amounts of saturated charges and rise constant k values for the toners obtained are shown in Table 7.

Comparative Example 1

A black toner and a developer were prepared in the same manner as in Example 1, except that the charge control agent was replaced with ungranulated zinc 3,5-di-t-butylsalicylate compound.

Five parts of this toner was admixed with 95 parts of an iron powder carrier to yield a developer. The amount of blowoff charges of this developer was determined (Toshiba Chemical TB-200 analyzer used). The amount of charges after 120 minutes was −34.3 $\mu$C/g.

The amount of saturated charges and rise constant k value for the toner obtained are shown in Table 7; the temporal changes in the amount of charges are shown in FIG. 1; the charge rise line is shown in FIG. 2.

When this toner was used to repeatedly form toner images in 20,000 copies using a commercial copying machine, unsatisfactory images with fogging and reduced image density in comparison with initial images were obtained.

Comparative Example 2

A blue toner and a developer were prepared in the same manner as in Example 2, except that the charge control agent was replaced with ungranulated aluminum 3,5-di-t-butylsalicylate compound.

Five parts of this toner was admixed with 95 parts of an iron powder carrier to yield a developer. The amount of blowoff charges of this developer was determined (Toshiba Chemical TB-200 analyzer used). The amount of charges after 120 minutes was −35.0 $\mu$C/g.

The amount of saturated charges and rise constant k value for the toner obtained are shown in Table 7; the temporal changes in the amount of charges are shown in FIG. 3; the charge rise line is shown in FIG. 4.

When this toner was used to repeatedly form toner images in 20,000 copies using a commercial copying machine, unsatisfactory images with fogging and reduced image density in comparison with initial images were obtained.

What is claimed is:

1. Charge control agent consisting essentially of finely milled base particles containing at least one charge control substance, and a granulating agent, said base particles being granulated using said granulating agent, and said granulating agent being at least one member selected from the group consisting of anionic surfactants, nonionic surfactants, cationic surfactants, natural water-soluble high molecular compounds and synthetic water-soluble high molecular compounds.

2. Charge control agent of claim 1 wherein said base particles have been finely milled in the presence of said granulating agent before being granulated using said granulating agent.

3. Charge control agent of claim 1 wherein the mean particle diameter of said base particles is 0.1 to 8 μm.

4. Charge control agent of claim 1 wherein not less than 90% of the charge control agent particles granulated have a minor-to-major axial diameter ratio of 0.8 to 1.0.

5. Charge control agent of claim 1 wherein the mean particle diameter of the charge control agent particles granulated is 5 to 50 μm.

6. Charge control agent of claim 1 wherein not less than 90% of the charge control agent particles granulated have a particle diameter of 5 to 88 μm.

7. Charge control agent of claim 1 wherein the granulating agent is two or more selected from the group consisting of anionic surfactants, nonionic surfactants, cationic surfactants, natural water-soluble high molecular compounds and synthetic water-soluble high molecular compounds.

8. Charge control agent of claim 1 wherein the anionic surfactant is at least one selected from the group consisting of fatty acids and salts thereof, dialkyl sulfosuccinates, α-olefinsulfonates, alkyl benzenesulfonates, alkyl naphthalenesulfonates, alkyl sulfates, polyoxyethylene alkyl ether sulfates, alkyl phosphates, polyoxyethylene alkyl ether phosphates and naphthalenesulfonate formalin condensates.

9. Charge control agent of claim 1 wherein the nonionic surfactant is at least one selected from the group consisting of polyoxyethylene alkyl ethers, polyoxyethylene alkyl phenyl ethers, polyoxyethylene polyoxypropylene glycol, polyoxyethylene sorbitan fatty acid partial esters and fatty acid diethanolamides.

10. Charge control agent of claim 1 wherein the natural water-soluble high molecular compound is at least one selected from the group consisting of methyl cellulose, hydroxyethyl cellulose, hydroxypropylmethyl cellulose, carboxymethyl cellulose, chemically modified starch, gum arabic, algin, cyclodextrin, pullulan, casein, gelatin and lignin.

11. Charge control agent of claim 1 wherein the synthetic water-soluble high molecular compound is at least one selected from the group consisting of polyvinyl alcohol, polyethylene oxide, polyacrylates, styrene-maleic anhydride copolymer salts, olefin-maleic anhydride copolymer salts, polyvinylpyrrolidone polyethylene glycol, polyester, polyamide and polyurethane.

12. Charge control agent of claim 1 wherein the charge control substance is at least one selected from the group consisting of metal compounds having an aromatic hydroxycarboxylic acid as a ligand, metal compounds having an aromatic dicarboxylic acid as a ligand, metal compounds having a monoazo compound as a ligand, calix(n)arene compounds and quaternary ammonium salt compounds.

13. Charge control agent of claim 12 wherein the metal compound having an aromatic hydroxycarboxylic acid as a ligand comprises one or more compounds of Formulas (I) to (III) below:

(I)

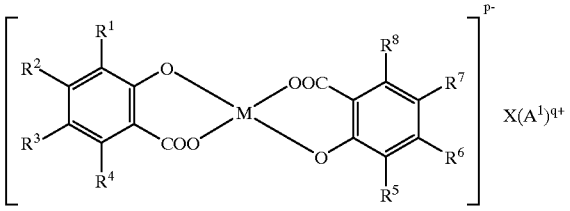

in Formula (I), each of $R^1$ to $R^8$ is H, a hydroxyl group, a normal or branched alkyl group having 1 to 12 carbon atoms, an alkenyl group, an aryl group, an aralkyl group, a halogen or a nitro group;

$R^1$ to $R^8$ may be identical or not;

M is a divalent, trivalent or tetravalent metal;

p is 0, 1 or 2;

q is 1 or 2;

$(A^1)^{q+}$ is $H^+$, $NH_4^+$, a cation based on an alkali metal, a cation based on an organic amine, or a quaternary organic ammonium ion; X is 0, 1 or 2;

(II)

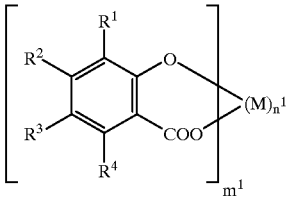

in Formula (II), each of $R^1$ to $R^4$ is H, a hydroxyl group, a normal or branched alkyl group having 1 to 12 carbon atoms, an alkenyl group, an aryl group, an aralkyl group, a halogen or a nitro group;

$R^1$ to $R^4$ may be identical or not;

$m^1$ is an integer of 3 or more;

$n^1$ is an integer of 1 or more;

M is a divalent or trivalent metal;

(III)

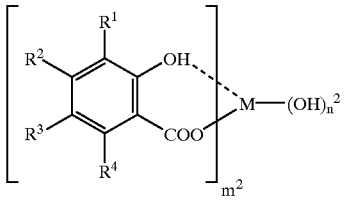

in Formula (III), each of $R^1$ to $R^4$ is H, a hydroxyl group, a normal or branched alkyl group having 1 to 12 carbon atoms, an alkenyl group, an aryl group, an aralkyl group, a halogen or a nitro group;

$R^1$ to $R^4$ may be identical or not;

M is a divalent or trivalent metal;

each of $m^2$ and $n^2$ is a positive integer;

$m^2+n^2$ represents the oxidation number of the metal M.

14. Charge control agent of claim 12 wherein a metal compound having an aromatic hydroxycarboxylic acid as a ligand, as a charge control substance, and the aromatic hydroxycarboxylic acid corresponding to the metal compound's ligand, are contained.

15. Charge control agent of claim 12 wherein the metal compound having a monoazo compound as a ligand comprises a compound of Formula (IV) below and/or a compound of Formula (V):

(IV)

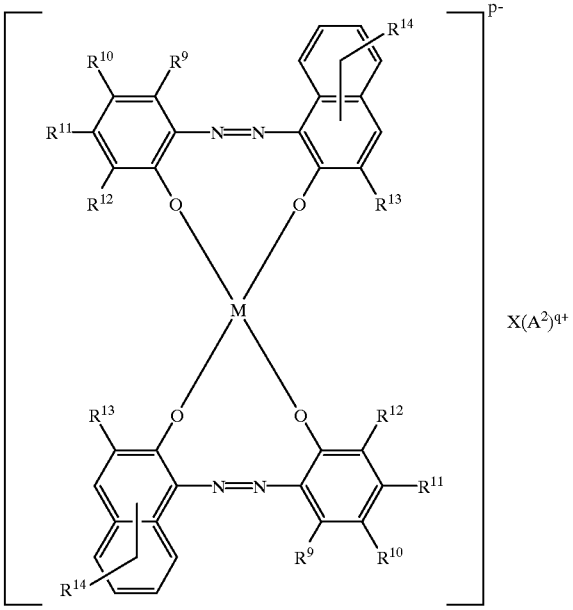

in Formula (IV), each of $R^9$ to $R^{12}$ and $R^{14}$ is H, a normal or branched alkyl group having 1 to 18 carbon atoms, a normal or branched alkenyl group having 2 to 18 carbon atoms, a sulfonamide group, a mesyl group, a sulfonic acid group, a hydroxyl group, an alkoxy group having 1 to 18 carbon atoms, an acetylamino group, a benzoylamino group, a halogen or —COO—$R^{15}$; $R^9$ to $R^{12}$ and $R^{14}$ may be identical or not; $R^{15}$ is a normal or branched alkyl group having 1 to 18 carbon atoms or an aryl group having 6 to 18 carbon atoms;

$R^{13}$ is H, a halogen, a nitro group, a carboxyl group, a normal or branched alkyl group having 1 to 18 carbon atoms, an alkenyl group having 2 to 18 carbon atoms, an alkoxy group having 1 to 18 carbon atoms, an aryl group having 6 to 18 carbon atoms, —COO—$R^{15}$ or

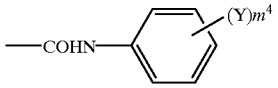

$R^{15}$ is a normal or branched alkyl group having 1 to 18 carbon atoms or an aryl group having 6 to 18 carbon atoms;

Y is H, a normal or branched alkyl group having 1 to 8 carbon atoms, an alkoxy group having 1 to 5 carbon atoms, a nitro group or a halogen;

$m^4$ is 1, 2 or 3;

M is a divalent, trivalent or tetravalent metal;

each of p and X is 0, 1 or 2;

q is 1 or 2;

$(A^2)^{q+}$ is $H^+$, $NH_4^+$, a cation based on an alkali metal, a cation based on an organic amine, or a quaternary organic ammonium ion;

(V)

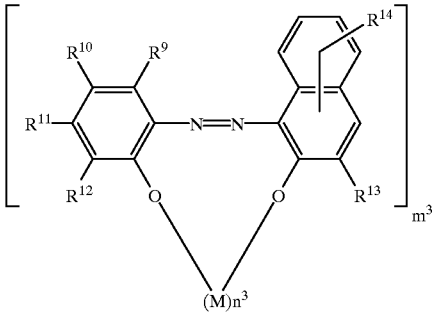

in Formula (V), each of $R^9$ to $R^{12}$ and $R^{14}$ is H, a normal or branched alkyl group having 1 to 18 carbon atoms, a normal or branched alkenyl group having 2 to 18 carbon atoms, a sulfonamide group, a mesyl group, a sulfonic acid group, a hydroxyl group, an alkoxy group having 1 to 18 carbon atoms, an acetylamino group, a benzoylamino group, a halogen or —COO—$R^{15}$; $R^9$ to $R^{12}$ and $R^{14}$ may be identical or not; $R^{15}$ is a normal or branched alkyl group having 1 to 18 carbon atoms or an aryl group having 6 to 18 carbon atoms;

$R^{13}$ is H, a halogen, a nitro group, a carboxyl group, a normal or branched alkyl group having 1 to 18 carbon atoms, an alkenyl group having 2 to 18 carbon atoms, an alkoxy group having 1 to 18 carbon atoms, an aryl group having 6 to 18 carbon atoms, —COO—$R^{15}$ or

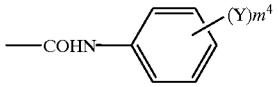

$R^{15}$ is a normal or branched alkyl group having 1 to 18 carbon atoms or an aryl group having 6 to 18 carbon atoms;

Y is H, a normal or branched alkyl group having 1 to 8 carbon atoms, an alkoxy group having 1 to 5 carbon atoms, a nitro group or a halogen;

$m^3$ is an integer of 3 or more;

$n^3$ is an integer of 1 or more;

$m^4$ is 1, 2 or 3;

M is a divalent or trivalent metal.

16. Charge control agent of claim 12 wherein a metal compound having a monoazo compound as a ligand, as a charge control substance, and the monoazo compound corresponding to the metal compound's ligand, are contained.

17. Charge control agent of claim 12 wherein the central metal in the metal compound having an aromatic hydroxycarboxylic acid as a ligand, as a charge control substance, is a metal selected from the group consisting of Zn, Cr, Al, Ti and Fe.

18. Charge control agent of claim 12 wherein the central metal in the metal compound having a monoazo compound as a ligand, as a charge control substance, is a metal selected from the group consisting of Zn, Cr, Al, Ti and Fe.

19. Toner for developing electrostatic images comprising the combination of a charge control agent for the purpose of charge control, a coloring agent and a resin, said charge control agent consisting essentially of base particles containing at least one charge control substance, and a granulating agent, said base particles being granulated using said granulating agent before being combined with the coloring agent and resin, and said granulating agent being at least one member selected from the group consisting of anionic surfactants, nonionic surfactants, cationic surfactants, natural water-soluble high molecular compounds and synthetic water-soluble high molecular compounds.

20. Toner of claim 19 for developing electrostatic images wherein the granulated base particles are dispersed in the resin.

21. Process for manufacturing a charge control agent comprising a fine milling step for finely milling base particles consisting essentially of a charge control substance, and a granulation step for granulating the finely milled base particles using a granulating agent, said granulating agent being at last one member selected from the group consisting of anionic surfactants, nonionic surfactants, cationic surfactants, natural water-soluble high molecular compounds and synthetic water-soluble high molecular compounds.

22. Process of claim 21 for manufacturing a charge control agent wherein the fine milling step and the granulation step are performed in an aqueous system.

23. Charge control agent of claim 1 wherein the mean particle diameter of said finely milled base particles is 0.1 to 3 $\mu$m.

24. Charge control agent consisting essentially of finely milled base particles containing at least one charge control substance, and a granulating agent, said base particles being granulated using said granulating agent, and said granulating agent being at least one member selected from the group consisting of anionic surfactants, nonionic surfactants, cationic surfactants, natural water-soluble high molecular compounds and synthetic water-soluble high molecular compounds, wherein said base particles have been finely milled in the presence of said granulating agent before being granulated using said granulating agent, wherein the mean particle diameter of the finely milled base particles is 0.1 to 8 $\mu$m, and wherein not less than 90% of the granulated charge control agent particles have a minor-to-major axial diameter ratio of 0.8 to 1.0.

25. Charge control agent of claim 24 wherein the charge control substance is at least one member selected from the group consisting of metal compounds having an aromatic hydroxycarboxylic acid as a ligand, metal compounds having an aromatic dicarboxylic acid as a ligand, metal compounds having a monoazo compound as a ligand, calix(n) arene compounds and quaternary ammonium salt compounds.

26. Charge control agent of claim 24 wherein the mean particle diameter of the finely milled base particles is 0.1 to 3 $\mu$m.

27. Toner for developing electrostatic images comprising the combination of a charge control agent for the purpose of charge control, a coloring agent and a resin, said charge control agent consisting essentially of base particles containing at least one charge control substance, and a granulating agent, said base particles being granulated using said granulating agent before being combined with the coloring agent and resin, and said granulating agent being at least one member selected from the group consisting of anionic surfactants, nonionic surfactants, cationic surfactants, natural water-soluble high molecular compounds and synthetic water-soluble high molecular compounds, wherein said base particles have been finely milled in the presence of said granulating agent before being granulated using said granulating agent, wherein the mean particle diameter of the finely milled base particles is 0.1 to 8 $\mu$m, and wherein not less than 90% of the granulated charge control agent particles have a minor-to-major axial diameter ratio of 0.8 to 1.0.

28. Toner of claim 27 wherein the charge control substance is at least one member selected from the group consisting of metal compounds having an aromatic hydroxycarboxylic acid as a ligand, metal compounds having an aromatic dicarboxylic acid as a ligand, metal compounds having a monoazo compound as a ligand, calix(n)arene compounds and quaternary ammonium salt compounds.

29. Toner of claim 27 wherein the mean particle diameter of the finely milled base particles is 0.1 to 3 $\mu$m.

30. Toner of claim 27 wherein the granulated base particles are dispersed in the resin.

31. Process of claim 21 wherein the base particles are finely milled to a mean particle size of 0.1 to 8 $\mu$m.

32. Process of claim 21 wherein not less than 90% of the granulated charge control agent particles have a minor-to-major axial diameter ratio of 0.8 to 1.0.

33. Process of claim 21 wherein the charge control substance is at least one member selected from the group consisting of metal compounds having an aromatic hydroxycarboxylic acid as a ligand, metal compounds having an aromatic dicarboxylic acid as a ligand, metal compounds having a monoazo compound as a ligand, calix(n)arene compounds and quaternary ammonium salt compounds.

34. Process for manufacturing a toner comprising finely milling base particles consisting essentially of a charge control substance, granulating the finely milled base particles using a granulating agent selected from the group consisting of anionic surfactants, nonionic surfactants, cationic surfactants, natural water-soluble high molecular compounds and synthetic water-soluble high molecular compounds, and thereafter combining the granulated base particles with a coloring agent and a toner resin to form toner particles.

35. Process of claim 34 wherein the base particles are finely milled to a mean particle size of 0.1 to 8 $\mu$m.

36. Process of claim 34 wherein the charge control substance is at least one member selected from the group consisting of metal compounds having an aromatic hydroxycarboxylic acid as a ligand, metal compounds having an aromatic dicarboxylic acid as a ligand, metal compounds having a monoazo compound as a ligand, calix(n)arene compounds and quaternary ammonium salt compounds.

* * * * *